US006767595B2

(12) United States Patent
Prevost et al.

(10) Patent No.: US 6,767,595 B2
(45) Date of Patent: Jul. 27, 2004

(54) SYNTHETIC GRASS SPORT SURFACES

(75) Inventors: Jean Prevost, Cote St. Luc (CA); John Gilman, Hampstead (CA)

(73) Assignee: FieldTurf Inc., Montreal (CA)

( * ) Notice: Subject to any disclaimer, the term of this patent is extended or adjusted under 35 U.S.C. 154(b) by 0 days.

(21) Appl. No.: 09/818,857

(22) Filed: Mar. 28, 2001

(65) Prior Publication Data

US 2002/0081399 A1 Jun. 27, 2002

Related U.S. Application Data

(60) Provisional application No. 60/256,961, filed on Dec. 21, 2000.

(51) Int. Cl.[7] ..... B32B 3/02

(52) U.S. Cl. ..... 428/17; 428/212; 273/DIG. 13

(58) Field of Search ..... 428/15, 17, 95, 428/87, 212, 331; 273/DIG. 13; 473/278, 490

(56) References Cited

U.S. PATENT DOCUMENTS 5,958,527 A * 9/1999 Prevost ..... 428/17

FOREIGN PATENT DOCUMENTS

CA 2218314 9/1998

* cited by examiner

*Primary Examiner*—Deborah Jones
*Assistant Examiner*—Abraham Bahta
(74) *Attorney, Agent, or Firm*—Birch, Stewart, Kolasch & Birch, LLP

(57) ABSTRACT

A synthetic grass sport surface (10) suited for use in a baseball field includes an infill layer (16) of particulate material evenly spread among rows of ribbons (14) extending upwardly from a backing mat (12). The infill layer (16) includes a top covering sub-layer (26) of non-marking material, such as recycled rubber used in the manufacture of soles for running shoes. A checkered pattern of alternating color tones is formed on the synthetic grass surface (16) for improving the natural appearance thereof. The synthetic grass surface also includes a synthetic grass warning track (34) having different tangible properties to alert a player stepping thereon that he is approaching an obstacle.

8 Claims, 4 Drawing Sheets

SYNTHETIC GRASS SPORT SURFACES

This application claims the benefit of Provisional application No. 60/256,961 filed Dec. 21, 2000.

BACKGROUND OF THE INVENTION

1. Field of the Invention

The present invention relates to synthetic grass surfaces and, more particularly, to a synthetic grass sport surface suited for ball games, such as baseball, cricket, golf and any sport that has a ball landing or rolling on the surface.

2. Description of the Prior Art

Synthetic grass sport surfaces are well known. They are used to replace natural grass surfaces which do not stand up well to wear and which require a great deal of maintenance.

In ball games, such as baseball, cricket, soccer, tennis and golf, one concern has always been to provide a synthetic grass surface which would virtually not affect the travelling direction of a ball rolling thereon, but which would still closely emulate the appearance of natural grass. A ball must roll true in any direction. The means employed to provide the appearance of natural grass must not affect the preferred non-directional properties of the synthetic grass.

Another concern is the provision of a synthetic grass sport surface having a layer of infill particulate material which will not create streaks on a ball when the same comes in contact therewith after having been hit or thrown by a player. The provision of a non-marking playing surface is particularly essential to the upper level of play in the college and professional baseball ranks so that the white leather balls used be not constantly rejected by an umpire because of streaks thereon created from the contact of the ball with the infill of the playing surface.

It has also been found that there is a need for a new synthetic grass baseball playing surface having a synthetic grass outfield surface and a synthetic grass warning track of different tangible properties to alert an outfielder focusing on a ball in flight that he is approaching an obstacle, such as an outfield fence.

SUMMARY OF THE INVENTION

It is therefore an aim of the present invention to provide a new synthetic playing surface which is less subject to creating streaks on a sport ball rolling thereon.

It is also an aim of the present invention to provide a new synthetic grass sport surface which more closely emulate the appearance of a natural grass sport surface.

It is a further aim of the present invention to provide a new synthetic grass warning track to alert a player that he is approaching an obstacle.

Therefore, in accordance with the present invention, there is provided a synthetic grass playing surface which is provided with an improved infill layer of particulate material. The infill layer preferably comprises a non-marking particulate material which is distributed so as to prevent a ball from being marked when the same hits the synthetic grass playing surface.

Also in accordance with the present invention, there is provided a synthetic grass playing surface having a lawn mowing pattern imitation formed thereon by a checkered pattern of alternating synthetic grass sections of different color tones so as to simulate different grass mowing directions and, thus, improve the resemblance to a natural grass surface.

In accordance with a further general aspect of the present invention, there is provided a synthetic grass baseball playing surface having a synthetic grass outfield surface and a synthetic grass warning track, said synthetic grass warning track having tangible properties different from that of said synthetic grass outfield surface so as to alert an outfielder stepping thereon that he is approaching an obstacle.

In accordance with a further general aspect of the present invention, there is provided a method of forming a baseball warning track comprising the steps of installing a synthetic grass outfield surface having a backing and a plurality of synthetic ribbons extending upwardly therefrom, delimiting a warning track area and an outfield grass area on the synthetic grass outfield surface, and interspersing first and second layers of infill material among the ribbons of said warning track and outfield grass areas, respectively, the first and second layers having different overall tangible properties so that an outfielder stepping on the warning track area is alerted that he is approaching an obstacle.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
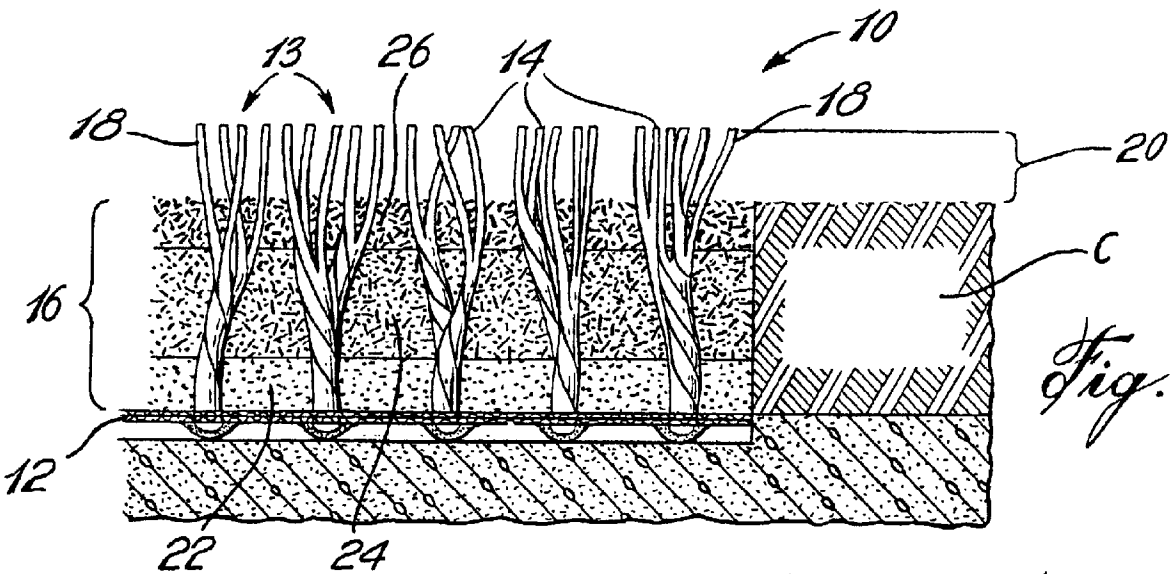
FIG. 1 is a schematic cross-section view of a synthetic grass baseball playing surface in accordance with a preferred embodiment of the present invention.

Now referring to the drawings, and in particular to FIG. 1, a synthetic grass baseball playing surface 10 embodying the characterizing elements of the present invention will be described.

The synthetic grass baseball playing surface 10 generally includes a thin flexible backing mat 12 with parallel rows 13 of synthetic ribbons 14 projecting upwardly from the backing mat 12, and representing grass blades. A relatively thick infill layer 16 of particulate material is provided on the baking mat 12 to support the ribbons 14 in a relatively upright position on the backing mat 12 and to provide resiliency to the surface 10. The backing mat 12 and the ribbons 14 are preferably of the type disclosed in U.S. Pat. No. 5,958,527, issued to Prevost on Sep. 28, 1999 and assigned to the Assignee of the present application, and the contents of which are incorporated herein by reference.

The ribbons 14 are made from suitable synthetic plastic material which is extruded in a strip that is relatively wide. The strips are mechanically fibrillated or split to approximately one-eight of an inch or more. The fibrillation, which is done during the manufacturing of the strip, provides a ribbon which resembles a hair net, that is, the resulting fibers are interconnected.

The rows 13 of ribbons 14 are spaced-apart by a distance that ranges between ⅝" and 2¼". Furthermore, it has been found that the thickness of the infill layer 16 should be about two-thirds the length of the ribbons 14 and that the free terminal ends 18 of the ribbons 14 should extend anywhere from ¼" to 1⅛"above the top surface of the infill layer 16 to form a top void 20. The infill layer can be about 1¼" to 2"thick. The top void 20 and, thus, the length of the ribbons 14 should be greater within about 15 feet of the home plate H (see FIG. 5) of the baseball field to contribute to prevent the particulate material of the infill layer 16 from being dislodged by a hard hit ball.

The infill layer 16 preferably comprises a base sub-layer 22 of sand, a main intermediate sub-layer 24 of a mixture of hard sand, such as silica, and cryogenically ground crumb rubber, and a top covering sub-layer 26 of non-marking ground rubber particles. The base layer 22 may include 1 lb. of sand per square foot of playing surface, whereas the top covering layer 26 may include 0.3 lb. to 1.5 lbs. of non-marking ground rubber particles. The amount of mixture of hard sand and cryogenically ground crumb rubber is calculated so as to obtain an infill layer having a desired thickness (for instance about 1⅛"or more depending on the friction the ball creates with the sport surface). According to a preferred embodiment of the present invention, the ratio sand/rubber is approximately equal to 3 or close to that number, but could be less if we use more sand in the bottom of the infill. However, it is noted that a greater proportion of rubber can be provided if the surface requires additional resiliency. The sand particles and the ground crumb rubber particles range in size between 10 mesh and 40 mesh. The non-marking rubber particles range in size between 4 mesh to 20 mesh. The non-marking rubber particles must be larger than the underlying ground crumb rubber and sand particles to prevent the non-marking particles from falling therein.

The non-marking ground rubber particles forming the top covering layer 26 preferably consist of particulate material made from recycled soles of running shoes that have non-marking rubber. Alternatively, the non-marking material could be made of other non-marking rubber e.p.d.m, plastics with relatively high specific gravity ratio, round stone or sand. The non-marking material must be of such quality and composition such that it does not oxidize too much under UV rays. If the non-marking material oxidizes, it may mark up the balls. By evenly spreading a topcoat of non-marking material on the underlying infill material, streaks on the ball resulting from the ball entering in collision with the synthetic grass surface 10 and infill layer 16 are virtually prevented, thereby prolonging the service life of the ball. It is pointed out that the top void 20 also adds to the non-marking features of the present system.

Instead of solely forming a top covering layer 26 of non-marking material, the entire infill layer 16 could be of a non-marking kind.

Non-marking material could also be used for other sports, such as soccer, golf and in all sports in which a ball is rolled or the ball impacts on a playing field. In a golf application, the non-marking rubber material would advantageously contribute to reduce abrasion on the golf balls as well as not marking them.

The synthetic grass baseball playing surface 10 could be provided in a modular form including a number of individual synthetic grass units adapted to be laid flat on a field and fit side by side to provide a flat and continuous synthetic grass surface. The synthetic grass units are preferably installed from the home plate H through the second base B2 as with the rolls of artificial grass. The grain (i.e. the direction and pattern in which the ribbons 14 extend from their original packaging condition) must preferably be lying towards the outfield. The foul lines F1, F2 (FIGS. 5*a* and 5*b*) can be installed from synthetic grass units having white lines formed thereon. The synthetic grass units with the white lines thereon are installed parallel to the foul lines F1 and F2.

Figure 5A:
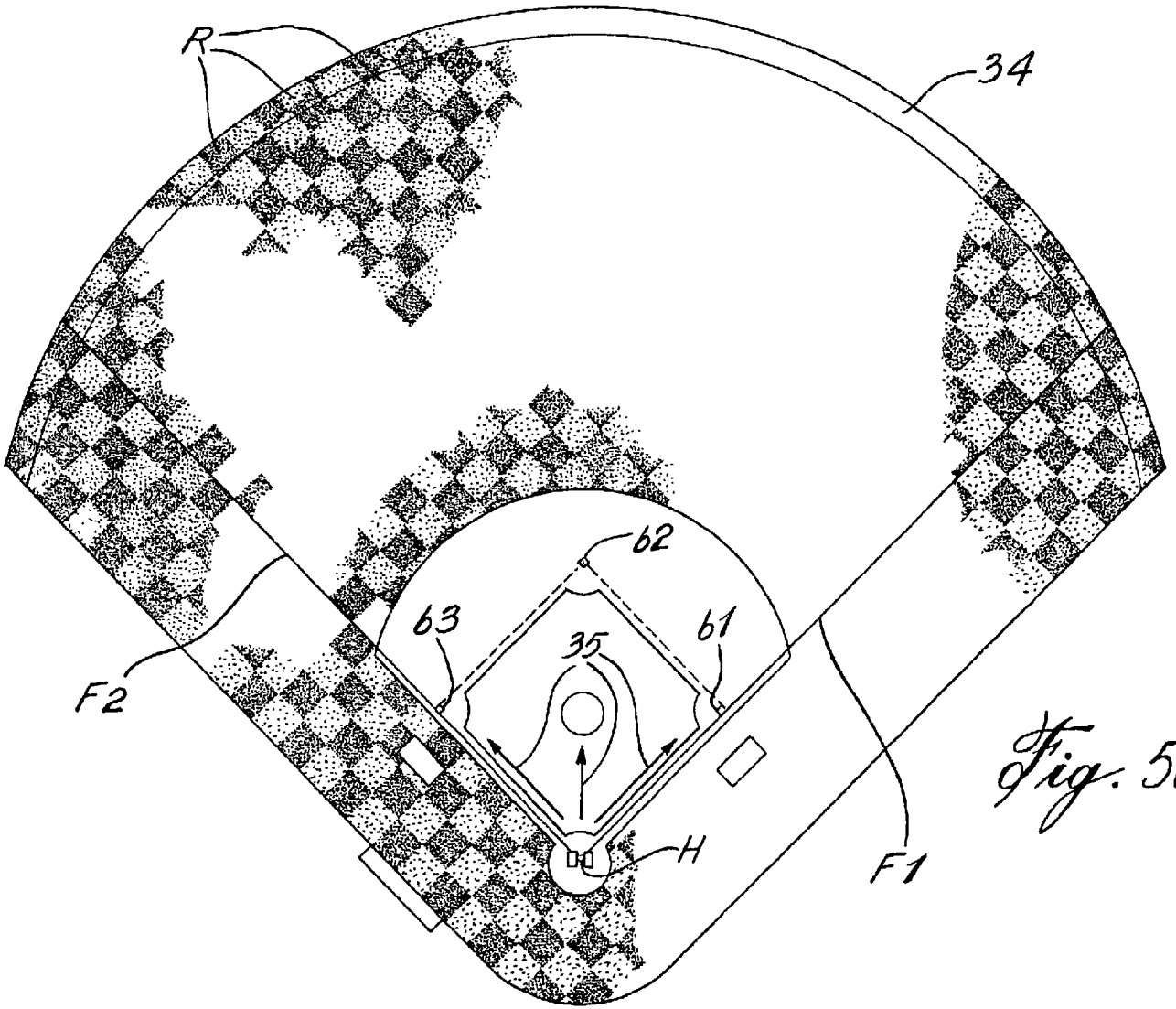
FIGS. 5*a* and 5*b* are top plan views of a baseball field.
Figure 5B:
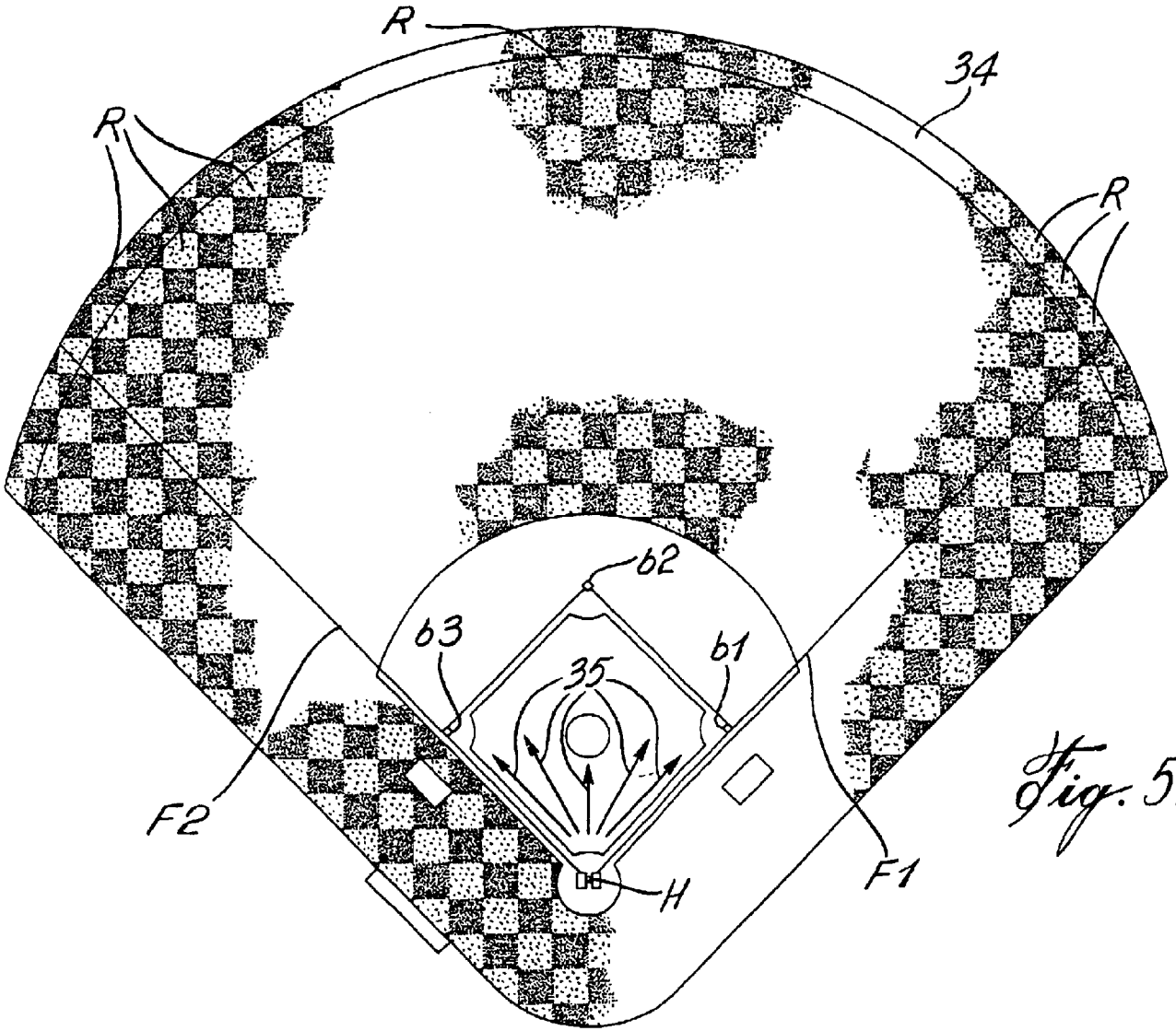

Alternatively, the infield and the outfield could be formed from rolls R of synthetic grass laid side by side on the field ground so that the original grain of the synthetic grass generally extends towards the outfield fence (not shown). As seen in FIG. 5*b*, the rolls of synthetic grass are preferably installed from the home plate H through the second base B2. However, as seen in FIG. 5*a*, the rolls R of synthetic grass could also be installed parallel to either one of the first or the third base line F1 and F2 to reduce the waste. Once installed, the synthetic grass is fibrillated and brushed to remove the grain therefrom and, thus, ensure a uniform ball roll.

Once the synthetic grass surface 10 has been laid on the field ground, the infill layer 16 of particulate material is distributed between the ribbons 14. More particularly, the infilling procedure comprises the steps of first installing successive thin layers of sand in view of forming the base layer 22 and then additional layers of sand are installed to complete the base layer 22 and the sand is brushed in. After having installed the base layer 22, the main intermediate layer 24 of pre-mixed sand and rubber is installed gradually. This layer can also be layered in special cases where there is not enough room to mix the infill. This step is repeated until the level of the infill layer 16 reaches the desired height. Prior to adding the top covering layer 26 of non-marking particulate material, the synthetic grass surface 10 needs to be seriously further fibrillated so that the surface takes on a general non-directional result and, thus, allows a ball to roll straight in any direction on the playing surface 10. Next, combing the grass in a generally radial direction, as depicted by arrows 35 (see FIG. 1) from the home plate towards the outfield is essential until the synthetic grass becomes very uniform. Combing is effected by rotating a stiff nylon or plastic bristled brush into the synthetic grass surface 10 by applying pressure to get all the ribbons 14 laying in a same direction or by using a rake type of unit with metal prongs that adequately agitate the blades of grass (ribbons 14) in the desired direction. The individual ribbons 14 need to be additionally fibrillated and combed so the ribbons 14 that are split are really individual fibers. This will cause the fibers to lay over more easily and interlock, thereby trapping the infill particulate material in the synthetic grass surface 10. The combing and brushing action are also designed to perfectly level the infill in the surface so the final layer(s) of non-marking material is/are installed evenly. Thereafter, the final layer(s) of non-marking material is/are added in a very precise manner.

The on site fibrillating operation is done using a nylon brush (not shown) that is preferably rotating or by a steel brush or a combination of both. The playing surface 10 must be brushed several times during the infilling process. It has been found that the surface 10 should be brushed primarily only radially from the home plate H towards the outfield, as illustrated by arrows 35 in FIGS. 5*a* and 5*b*. This should be done late in the process. Brushing in any other direction will create grain that the operator will have to subsequently undo. Once the intermediate layer 24 has nearly reached the desired level, a final infill leveling pass has to be made to properly level the intermediate layer 24 in a uniform manner to accept the top covering layer 26. When doing this final leveling pass, the combination steel and/or nylon brush or a brush with all metal bristles should be used. This final pass must be done only in a generally radial direction (see FIGS. 5*a* and 5*b*) from the home plate H to the end of the outfield. This will prevent creating grain in a wrong direction. To properly assess the amount of fibrillation required, the operator will need to closely inspect the ribbons 14 to be sure they are split individually.

Once the grass has been properly fibrillated and the intermediate layer 24 properly leveled, the top covering layer 26 of non-marking rubber particles is ready to install. The top covering layer 26 must be installed very evenly and at the right rate in order to not have to seriously agitate the synthetic grass to make all of the non-marking rubber particles fall into the underlying sub-layers of the infill layer 16. As mentioned hereinbefore, the size of the non-marking particles must be larger than that of the underlying particles. Once the top covering layer 26 is down, the synthetic grass baseball playing surface 10 can be brushed by not rotating the brush but by placing the same at an angle and lowering it to the depth of the infill layer 16 or by using a soft drag brush. The brush must then be driven back and forth a few times to lightly agitate the ribbons 14 just enough to make the top infill material, i.e. the non-marking rubber particles drop onto the underlying infill material but not mixing the non-marking rubber particles and the underlying infill material. The infill material can then be compacted using a vibrating 2000 to 3000 lbs. roller. The final step of the fibrillating process consists of pulling a 15 foot drag brush or smaller attached to a three point hitch in one direction only, towards the outfield in a very uniform pattern always being sure that there is no mixing of the non-marking material and the underlying infill material.

The clay C surrounding the bases and the home plate needs to be leveled at the same level as the top covering level 26 of infill material. Stepping on the transition of the two surfaces must result in a perfectly flat area at all points. The ribbons 14 will protrude above the clay C and will look like real grass. The leveling of the clay zones is accomplished only after the infilling procedure of the synthetic grass surface 10 is completed. The amount of infill material in the synthetic grass needs to stay constant so a small border (not shown) of plastic or ⅛" fiberboard can be temporarily placed in an upright position to keep the infill material in the synthetic grass while the clay C is installed at the proper level. The clay C next to the synthetic grass surface 10 needs to be compacted properly. Once the clay C is installed, the border can be removed and fine-tuning can proceed. To obtain a real grass look, the synthetic grass surface 10 needs to be raked up at its juncture with the clay C. This is accomplished by hand raking the grass in a straight line and tucking in dry clay C next to the synthetic grass surface 10 in order to prevent the infill material from falling out. The wide blades of fiber in the synthetic grass keep the clay from falling in between these blades of grass. However, if there was too much fibrillation of the fibers, the edge would not look so real.

Another method of obtaining a non-directional surface, i.e. a surface in which the fibers forming the surface extend in no specific visual pattern or direction but are rather randomly oriented, consists of twisting individual strips of slit ribbons together to form a fibrous tuft. The number of twisted slit ribbons twisted together can modify the playing characteristics of the field surface to achieve the anticipated results. These slit ribbons would not need to be fibrillated on site since they would be already individual ribbons. Another reason to use slit ribbons is to have stronger individual strands of ribbons if necessary. When fibrillating pre-fibrillated fibers on site, the result is that some of the fibrillated or split fibers become smaller that what may be more desirable. These smaller ribbons are the ones that wear first. They are by their physical nature more fragile than the larger fibers and therefore are not really desirable. Therefore, by using the slit ribbon fiber, a more predictable life span duration is possible as well as a more predictable ball roll and or field result. However, infilling slit ribbons is much harder since they tend to fall with the weight of the sand or rubber.

By having the same sized fiber blades, a more uniform surface could be attained since rolling the fibers will mat them down evenly because they are of uniform size.

Figure 2:
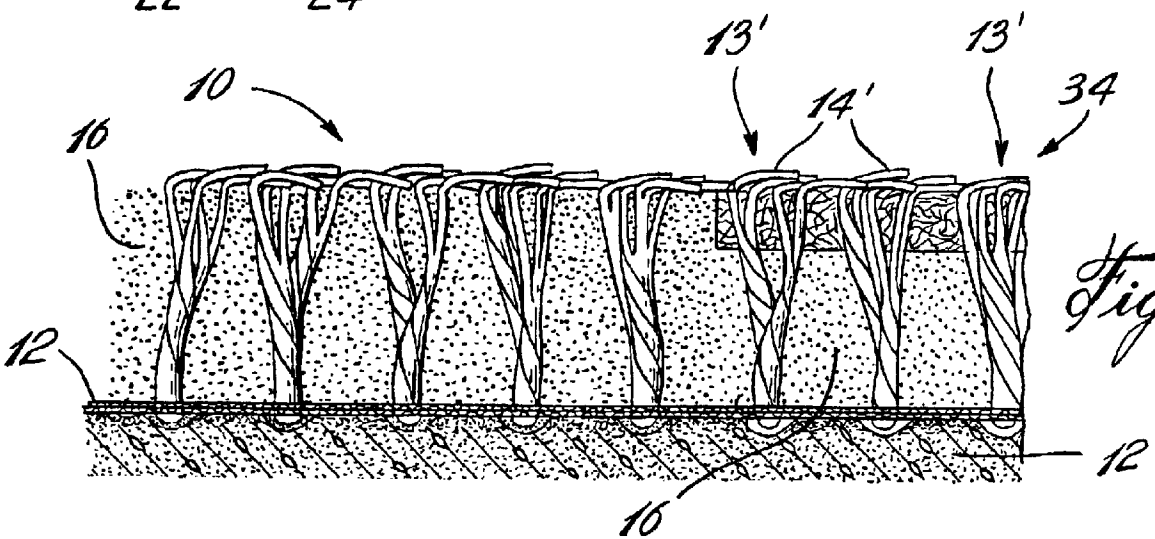
FIG. 2 is a schematic cross-section view of a synthetic grass baseball playing surface having a synthetic grass warning track formed therewith.

As shown in FIG. 2, the synthetic grass baseball playing surface 10 includes a synthetic grass warning track 34 having tangible properties (firmness, resiliency, coefficient of friction etc. . . . ) different from that of the synthetic grass surface laid on the outfield ground so as to alert an outfielder focusing on a ball flight that he is approaching the outfield fence (not shown). The difference in tangible properties between the warning track 34 and the synthetic grass outfield surface 10 can be achieved by varying the spacing between the rows 13' of ribbons 14', the stiffness of ribbons 14', the length of the ribbons, the thickness of the infill layer 16', the type of infill material, etc. . . .

The warning track 34 can be made with more or less the same composition of grass than that of the outfield, with a different density of grass, or of a different contrasting color to easily catch the eye of the player. However, it is preferable to use a radically different texture underfoot so that the baseball player will recognize the warning track 34 as he steps thereon. This can be done by modifying the infill to change the actual feel underfoot. Using an all sand infill could achieve that result, or using entirely rubber infill could also achieve that result. Various other types of infill material, such as coal slag, granular rock, granulated brick particles, or granulated lava rock that will create a supporting surface having a different texture underfoot and that will produce a sound when stepped thereon could be used as well. These granulated particles are brushed in between the fibers of the field surface to a height that would cover the grass fibers.

Alternatively, the warning track 34 could be formed by providing a synthetic grass surface having a sand filled infill layer on which warning track clay is dispersed in a thickness adequate enough to completely cover the green synthetic grass underneath. This results in having a warning track surface that can be very easily converted to a playing surface for other sports applications.

By evenly infilling the synthetic grass surface with sand to a uniform level, a certain upper portion of the ribbons 14' can be void of infill 16'. This allows room in the synthetic grass matrix to accept the granulated infill mixture used to color the warning track 34' on a baseball field as well as a texture difference with the outfield surface.

The warning track infill material will be held in place by the fibers 14'. The friction created by the fibers 14' will make the warning track infill material stable.

For conversion to other sports not requiring a clay warning track, the warning track top infill material, for instance, clay granules, only need to be brushed off and removed from the area so as to expose the underlying synthetic grass which is infilled with sand or other suitable resilient particulate materials. A certain portion of the infill material could be removed from the synthetic grass and replaced, for instance, by adding a resilient infill of ground rubber if a resilient surface is required. This would advantageously eliminates the need to remove grass sections of a different color or texture that would be used to identify the warning track 34.

This would eliminate seams at the junction of the warning track and the outfield synthetic grass surface, reduce conversion time, possibly painting of lines in a specific areas by having them permanently installed if necessary, and would be far more efficient than having a different color of another material laid on the area to be converted.

The visual aspects of a baseball field are important. Uniformity and the appearance (of grass) is critical. It has been found that the overall natural appearance of a synthetic grass surface can be improved by creating a checkered pattern of light and dark green colored grass sections in order to emulate the strips left in a natural grass by a lawn mower machine due to the different grass trimming angles when the machine is driven in different directions.

Figure 3:
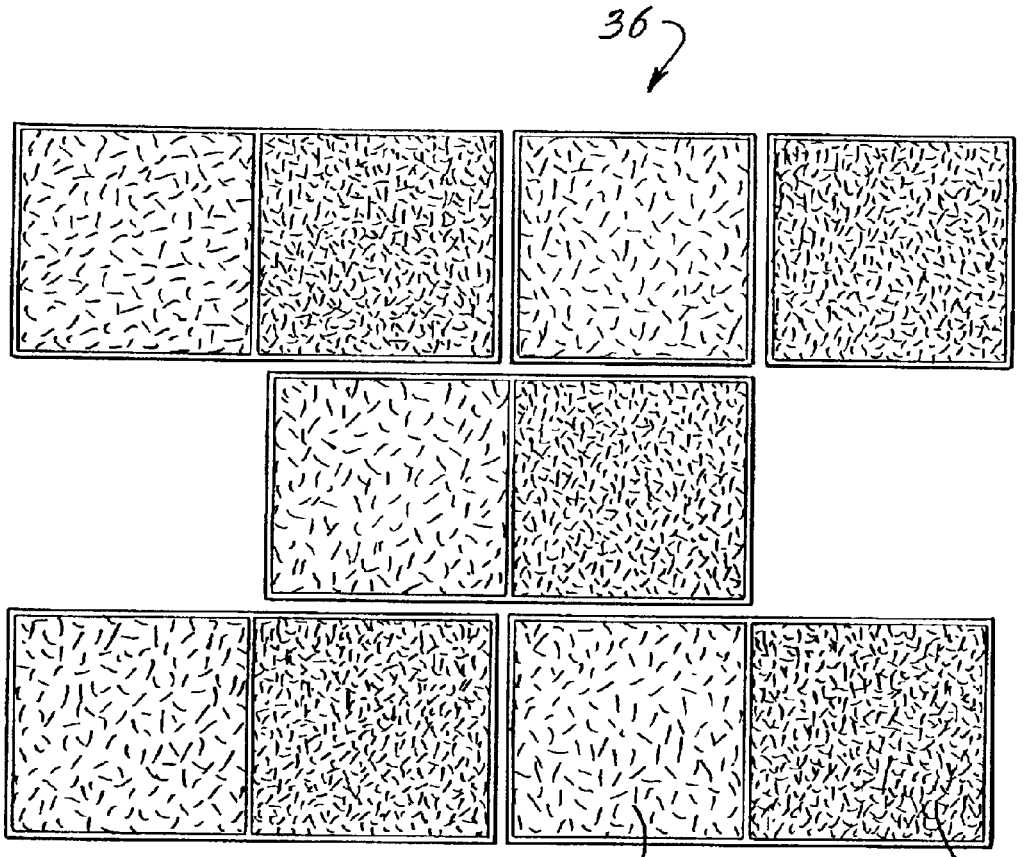
FIG. 3 is a schematic top plan view of a section of a synthetic grass surface having a checkered pattern formed thereon.

FIG. 3 illustrates a checkered pattern 36 including grass sections 38*a* and 38*b* of alternating color tones. It has been found that by creating a checkered pattern on a synthetic grass surface, the natural appearance thereof can be improved. The variation in color from one section to the other can be obtained by having grass sections of different ribbon densities, the denser grass section being darker. Alternatively, the grass sections, 38*a* and 38*b* could be provided with ribbons of different color tones. Also, the grass sections could be provided with ribbons oriented in different directions to provide the desired grass trimming pattern if the fiber grain does not affect play in a particular sport. The grass sections can be subsequently fibrillated to not affect the direction of travel of a ball rolling thereon for such applications that require a specific ball roll characteristic.

Figure 4:
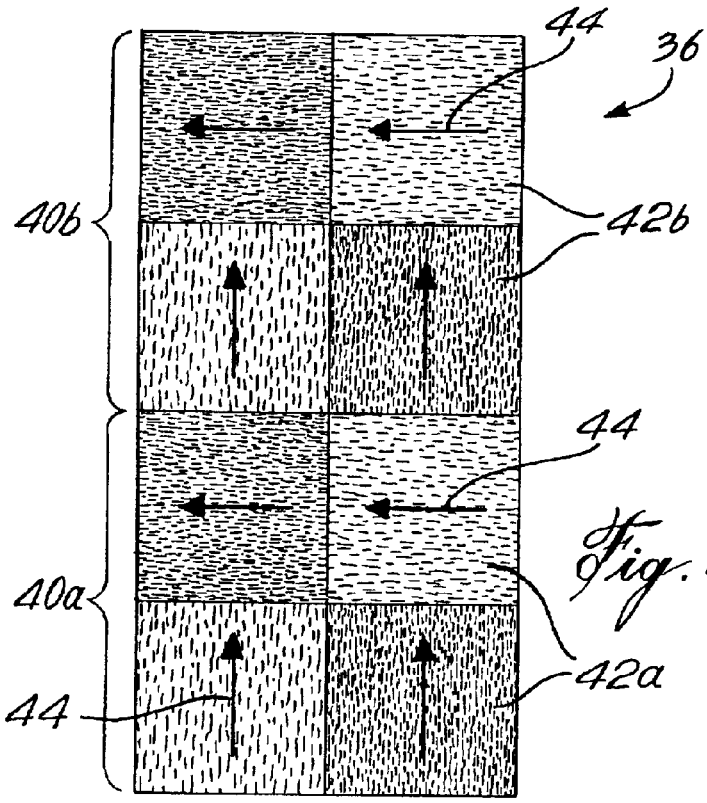
FIG. 4 is a schematic top plan view of a section of a synthetic grass surface having a checkered pattern formed thereon in accordance with a further embodiment of the present invention.

The synthetic grass surface is preferably manufactured in the form of synthetic grass panels 40*a* and 40*b* adapted to be placed side by side to form a continuous support surface. Each panel 40*a*/40*b* is formed of a number of square or rectangular grass sections 42*a* and 42*b* cut from different color tone grass panels and sewn, glued, or attached together by a hook and loop attachment in a criss crossed way to create a checkered pattern 36', as shown in FIG. 4. For instance, the grass sections 42*a* and 42*b* could be obtained from 15' wide panels of grass made in long lengths and cut at each 7½'. The sections of grass can be assembled together with respective ribbons or fibers thereof lying in different directions, as depicted by arrows 44 in FIG. 4. Once on site, the ribbons of grass panels are fibrillated to remove the grain directions thereof when it is desired to obtain a non-directional playing surface as explained hereinbefore.

What is claimed is:

1. A synthetic grass playing surface comprising a backing, a plurality of synthetic ribbons extending upwardly from said backing, and an infill layer of particulate material placed among said synthetic ribbons, said infill layer including a non-marking particulate material which is distributed so as to prevent a ball from being marked when the same hits the synthetic grass playing surface, wherein said non-marking particulate material is selected from a group consisting of: non-marking rubbers and non-marking plastics.

2. A synthetic grass playing surface as defined in claim 1, wherein said non-marking particulate material is at least partly resilient.

3. A synthetic grass playing surface as defined in claim 2, wherein said non-marking particulate material is made from recycled non-marking rubber of the type used in the manufactured of soles for running shoes.

4. A synthetic grass playing surface as defined in claim 1, wherein said non-marking particulate material is spread evenly among said ribbons to form a top covering layer for said infill layer at a distance below respective top ends of said ribbons.

5. A synthetic grass playing surface as defined in claim 4, wherein said top covering layer overlies a main sub-layer of mixture of hard sand and cryogenically ground rubber.

6. A synthetic grass playing surface as defined in claim 5, wherein said infill layer further includes a base sub-layer of sand between said backing and said main sub-layer.

7. A synthetic grass playing surface as defined in claim 1, wherein said synthetic grass playing surface is a baseball playing surface, and wherein said ribbons project between ¼" and 1⅛" above said infill layer.

8. A synthetic grass playing surface as defined in claim 7, wherein said infill layer is about 1¼" to about 2" thick.

* * * * *